US010516212B2

(12) United States Patent
Kim

(10) Patent No.: US 10,516,212 B2
(45) Date of Patent: Dec. 24, 2019

(54) RF PASSIVE DEVICE AND MINIATURIZATION METHOD THEREFOR

(71) Applicant: Mee Jeong Kim, Seoul (KR)

(72) Inventor: Mee Jeong Kim, Seoul (KR)

( * ) Notice: Subject to any disclaimer, the term of this patent is extended or adjusted under 35 U.S.C. 154(b) by 0 days.

(21) Appl. No.: 16/314,698

(22) PCT Filed: Jun. 19, 2017

(86) PCT No.: PCT/KR2017/006418
§ 371 (c)(1),
(2) Date: Jan. 2, 2019

(87) PCT Pub. No.: WO2018/004169
PCT Pub. Date: Jan. 4, 2018

(65) Prior Publication Data

US 2019/0207312 A1 Jul. 4, 2019

(30) Foreign Application Priority Data

Jul. 1, 2016 (KR) ..... 10-2016-0083573

(51) Int. Cl.
*H01Q 15/00* (2006.01)
*H01Q 7/00* (2006.01)
(Continued)

(52) U.S. Cl.
CPC ..... *H01Q 7/00* (2013.01); *H01Q 1/38* (2013.01); *H01Q 1/48* (2013.01)

(58) Field of Classification Search
CPC ..... H01Q 7/00; H01Q 1/38; H01Q 15/0086; H01Q 15/00
See application file for complete search history.

(56) References Cited

U.S. PATENT DOCUMENTS 9,595,765 B1 * 3/2017 Valayil ..... H01Q 13/18
10,283,856 B2 * 5/2019 Kim ..... H01Q 7/00
(Continued)

FOREIGN PATENT DOCUMENTS

KR 10-2009-0090017 A 8/2009
KR 10-2013-0076130 A 7/2013
(Continued)

OTHER PUBLICATIONS

Mi Jung Kim et al., "Miniaturized Resonator Using a Planar Mobius Strip Bisected Along the Circumferential Direction", 2006 IEEE MTT-S International Microwave Symposium Digest, pp. 1385-1388 (2006).

*Primary Examiner* — Dameon E Levi
*Assistant Examiner* — Hasan Z Islam
(74) *Attorney, Agent, or Firm* — Novick, Kim & Lee, PLLC; Jae Youn Kim

(57) ABSTRACT

Provided is an RF passive device ultra-miniaturized in a nanometer scale by inducing a surface plasmon resonance phenomenon by applying a metamaterial having a negative permittivity, and a method for miniaturizing the same. The RF passive device of the present invention includes: a radiator provided on a dielectric substrate; a ground plane onto which a metamaterial constituting each unit resonance cell is applied using a ring resonator of a quasi-Moebius strip structure; and a feed line for electrically connecting the radiator to the ground plane, in which an antenna is provided for inducing the surface plasmon resonance phenomenon between the atmosphere and the ground plane. As such, the surface plasmon resonance phenomenon can be induced by applying, to the ground plane, the metamaterial consisting of a unit resonance cell to which the ring resonator of a quasi-Moebius strip structure is applied.

9 Claims, 21 Drawing Sheets

(51) Int. Cl.
*H01Q 1/38* (2006.01)
*H01Q 1/48* (2006.01)

(56) References Cited

U.S. PATENT DOCUMENTS

| | | | | |
|---|---|---|---|---|
| 2011/0187601 | A1* | 8/2011 | Ryou | H01Q 9/0407 343/700 MS |
| 2014/0347240 | A1* | 11/2014 | Dandekar | H01Q 9/045 343/841 |
| 2015/0303870 | A1* | 10/2015 | Poddar | H03B 1/02 331/154 |

FOREIGN PATENT DOCUMENTS

| | | | |
|---|---|---|---|
| KR | 10-1282263 | B1 | 7/2013 |
| KR | 10-2013-0131620 | A | 12/2013 |
| KR | 20-2014-0001842 | U | 3/2014 |
| KR | 10-2015-0109363 | A | 10/2015 |

* cited by examiner

RF PASSIVE DEVICE AND MINIATURIZATION METHOD THEREFOR

TECHNICAL FIELD

The present invention relates to an RF passive device and a miniaturization method therefor, and more particularly, to an RF passive device by inducing a surface plasmon resonance phenomenon using a metamaterial and a miniaturization method therefor.

BACKGROUND ART

As wireless communication technology has been rapidly developed, various wireless communication systems, such as 4G/5G mobile communication terminals, wireless control systems, machine-to-machine communication, Internet of Things, Internet of Everything, and wireless sensor networks, are required for a miniaturized device having a lightweight and simple structure and easily integrated.

Accordingly, a radio frequency (RF) passive device in an antenna, an oscillator, a resonator or the like applied to the wireless communication systems has been gradually implemented as an integration and a monolithic microwave integrated circuit (MMIC).

In addition, there is a need for a passive device applicable to a minimized communication system, which is operable at a low power, applied to a nano communication system.

An existing method for miniaturizing a passive device includes a method of utilizing a characteristic of a perfect electric wall (PEC) or a perfect magnetic wall (PMC), and a system on chip (SoC) which is a semiconductor integration technology.

For example, Patent Document 1 (Korean Patent Publication No. 10-2015-0109363, published on Oct. 1, 2015) and Patent Document 2 (Korean Patent Registration No. 10-1282263, published on Jul. 10, 2013) disclose a technology for miniaturizing an antenna.

DISCLOSURE

Technical Problem

The highly integrated circuit (IC) requires more passive devices, however, to integrate passive devices into an integrated circuit is a very difficult technology.

It is because, unlike a digital field, the radio frequency (RF) system has a delicate and unique feature in an analog such as precise impedance matching, and is required for a unique device such as a high-power amplifier and a filter.

To solve the problems as mentioned above, an object of the present invention is to provide an RF passive device minimized in nanometers by inducing a surface plasmon resonance phenomenon by applying a metamaterial having a negative permittivity, and a miniaturization method therefor.

Another object of the present invention is to provide an RF passive device and a miniaturization method therefor, so that a surface plasmon resonance phenomenon occurring as a natural phenomenon in the THz frequency band is induced to a surface plasmon resonance phenomenon in MHz and GHz frequency bands mainly used in the communication systems.

A still another object of the present invention is to provide an RF passive device applied with a resonance type metamaterial and having a high quality factor (Q-factor) of the metamaterial due to the miniaturization of a unit cell, and a miniaturization method therefor.

Technical Solution

To achieve the above-mentioned object, the RF passive device according to the present invention includes: a radiator provided on a dielectric substrate; a ground plane onto which a metamaterial constituting each unit resonance cell is applied using a ring resonator of a quasi-Moebius strip structure; and a feed line for electrically connecting the radiator to the ground plane, wherein the passive device is prepared as an antenna to induce a surface plasmon resonance phenomenon between atmosphere and the ground plane.

In addition, to achieve the above-mentioned object, the method for miniaturizing the RF passive device according to the present invention includes: (a) constructing unit resonance cells by using a ring resonator having a quasi-Moebius strip structure; (b) applying a metamaterial provided with the unit resonance cells to a ground plane; and (c) electrically connecting a radiator to the ground plane by using a feed line, wherein the surface plasmon resonance phenomenon is induced between atmosphere and the ground plane, so that the antenna is miniaturized in nanometers.

Advantageous Effects

As mentioned above, according to the RF passive device and the miniaturization method therefor of the present invention, a metamaterial constituting a unit resonator cell applied with a ring resonator prepared as a quasi-Moebius strip is applied to the ground plane, so that the surface plasmon resonance phenomenon can be induced.

Particularly, according to the present invention, the surface plasmon resonance phenomenon, which occurs as a natural phenomenon in the THz frequency band, occurs in the MHz and GHz frequency bands by applying a material having a negative permittivity, so that the RF passive device can be miniaturized into a nanometer scale.

In addition, according to the present invention, the metamaterial constituting the ring resonator prepared as a quasi-Moebius strip is applied to the ground plane, thereby miniaturizing the unit resonator cell, so that a high Q-factor of the metamaterial can be obtained.

Particularly, according to the present invention, a stop bandwidth and a Q-factor that have a negative permeability can be controlled, based on a rotation angle of the ring resonator having the quasi-Moebius strip structure applied to each unit resonance cell about the feed line.

In addition, according to the present invention, due to the surface plasmon resonance phenomenon between the atmosphere and the ground plane of the antenna, a physical wavelength of a CPW antenna radiator can be minimized into a nanometer scale regardless of a structure and a size of the radiator.

In addition, according to the present invention, the surface plasmon phenomenon can be induced in a desired frequency band regardless of materials, such as graphene, metal, and copper, applied to the resonator, based on a structure of the ring resonator having the quasi-Moebius strip structure and the feed line applied to the unit resonance cell.

Therefore, according to the present invention, the MMIC of the RF passive device, which has difficulty in minimizing and integrating low-power RF passive device to communicate with nano communication systems, can be facilitated.

In addition, according to the present invention, the resonance frequency of the stop band is varied by adjusting the cutting number of the quasi-Moebius strip ring resonator constituting each unit resonance cell, and the stop bandwidth is variably controlled by controlling the rotation angle of the ring resonator, thereby varying a width of the loops constituting the quasi-Moebius strip, a spacing distance between the loops, a radius and a position of the via-hole, and a width of the bridge, so that the Q-factor of the stop bandwidth can be controlled.

BEST MODE

Mode for Invention

Hereinafter, the RF passive device and the miniaturization method therefor according to a preferred embodiment of the present invention will be described in detail with reference to the accompanying drawings.

The RF passive device according to the present invention incudes a surface plasmon resonance (SPR) phenomenon by applying a metamaterial having a negative permittivity, so that the RF passive device is minimized into a nanometer scale.

Hereinafter, a design method for miniaturizing a resonator by using a quasi-Moebius strip, a design method for controlling a Q-factor and a bandwidth, a method for designing a unit resonance cell of a metamaterial applied with a quasi-Moebius ring resonator, a method for designing a unit resonance cell of a metamaterial having a high Q-factor and a wide bandwidth, and a miniaturized antenna structure by using a surface plasmon resonance phenomenon will be described sequentially.

I. A Design Method for Miniaturizing a Resonator by Using a Quasi-Moebius Strip

1. A General Ring Resonator Structure

Figure 1:
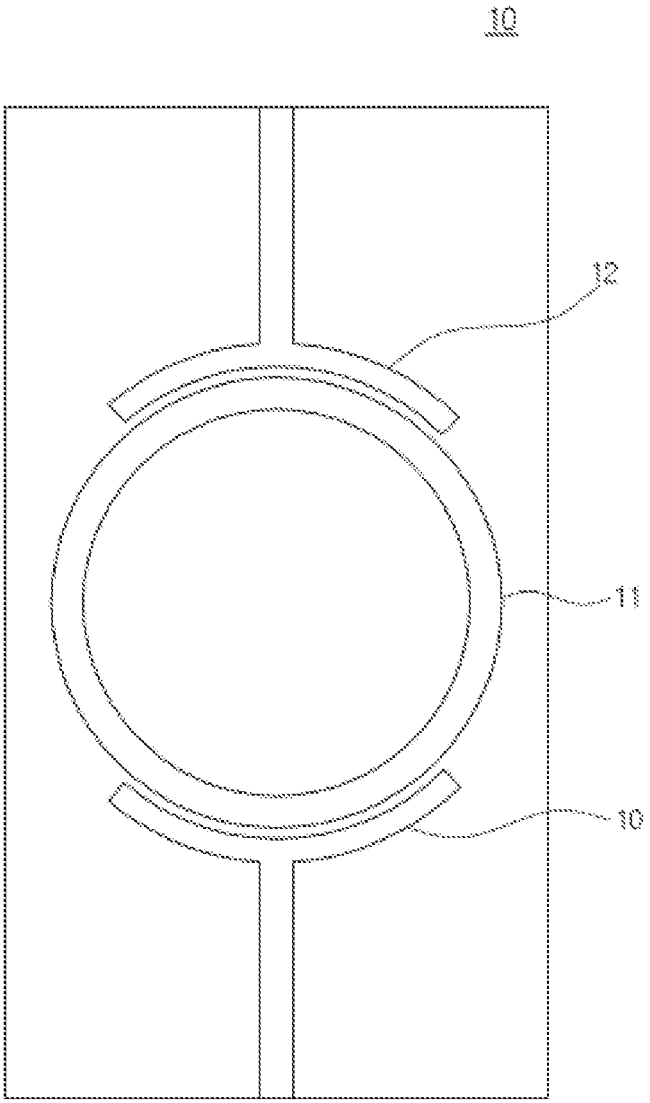
FIG. 1 is a schematic diagram showing a general ring resonator.
Figure 2:
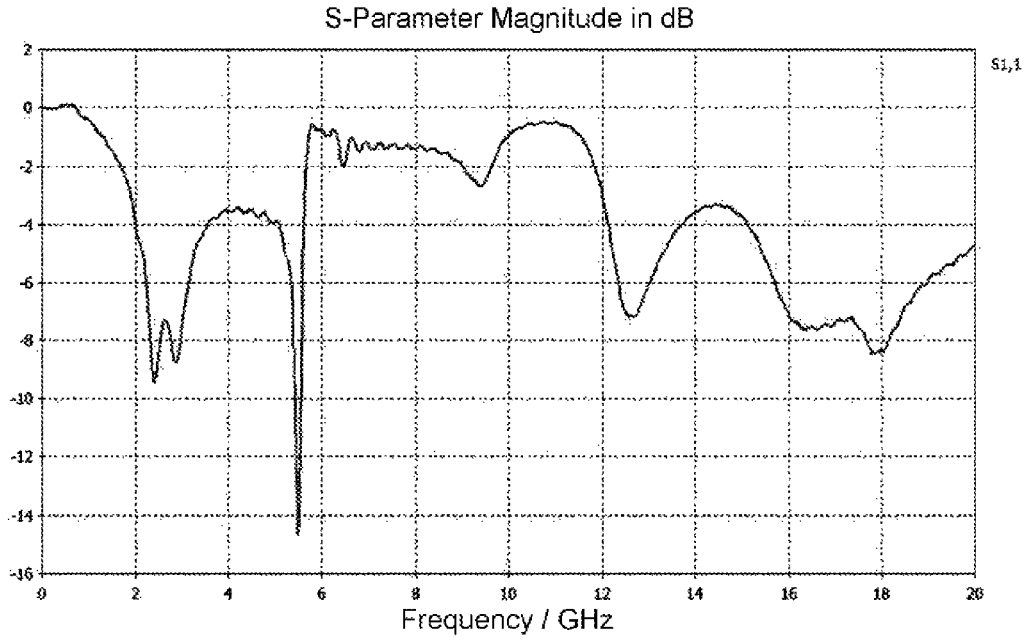
FIGS. 2 and 3 are graphs showing an input terminal reflection coefficient and a forward transfer coefficient of the general ring resonator shown in FIG. 1.
Figure 3:
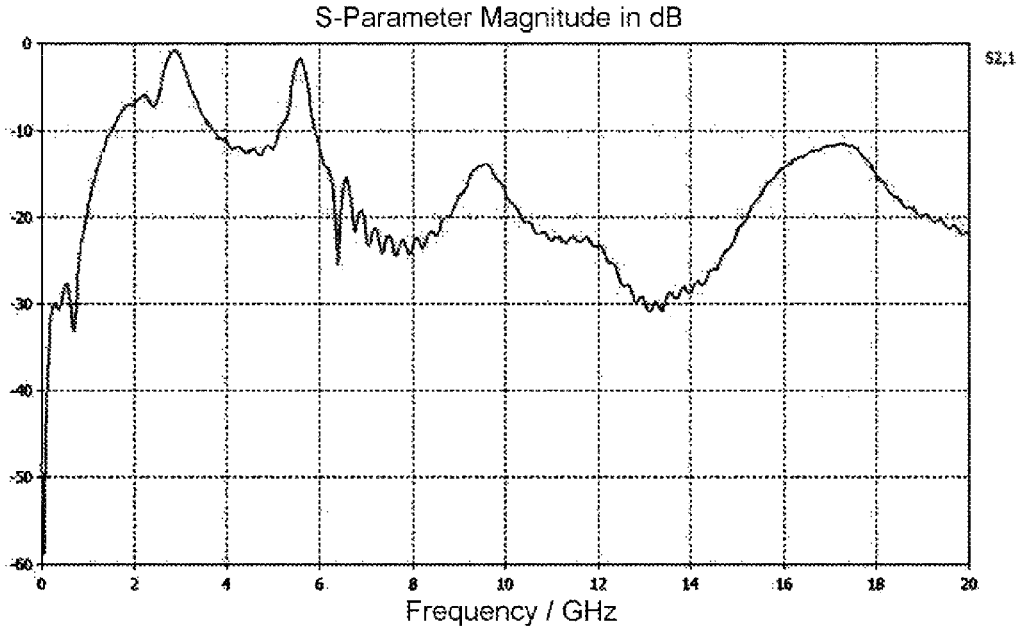
Figure 4:
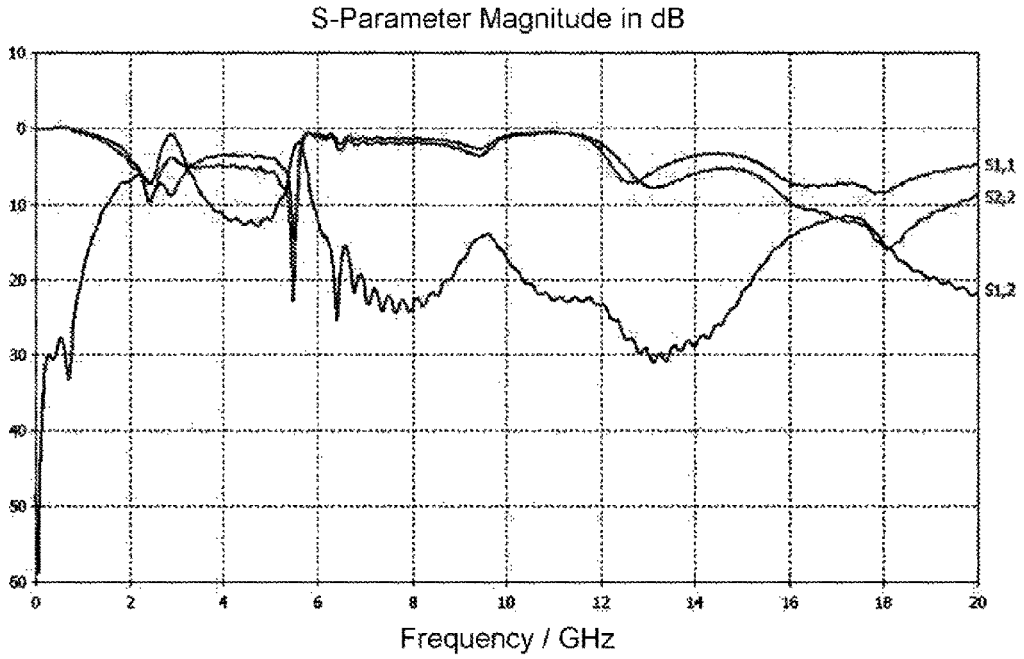
FIG. 4 is an S-parameter graph of the general ring resonator shown in FIG. 1.

FIG. 1 is a schematic diagram showing a general ring resonator. FIGS. 2 and 3 are graphs showing an input terminal reflection coefficient S11 and a forward transfer coefficient S21 of the general ring resonator shown in FIG. 1. FIG. 4 is an S-parameter graph of the general ring resonator shown in FIG. 1.

As shown in FIG. 1, the general ring resonator 10 includes a resonance pattern 11 formed as a ring shape and input/output ports 12 and 13 provided on both sides of the resonance pattern 11, that is, upper and lower sides viewed in FIG. 1, respectively.

The ring resonator 10 configured as described above may be used as a filter, which is a frequency selection device, due to the characteristic that a wave passing through the input/output ports 12 and 13 at one time and a wave returning to the resonance pattern 11 by one circulation time (and several circulation times) meet and interfere with each other at the output port 13.

The above ring resonator 10 has a feature similar to a Fabry-Perot resonator, and can solve the problem that an oscillation frequency becomes unstable due to a saturation-related phenomenon, which is so-called a (statial) hole burning and caused by forming a standing wave in the Fabry-Perot resonance structure.

Meanwhile, as shown in FIGS. 2 to 4, according to the S-parameter characteristic of a general ring resonator 10, the resonance occurs at about 6 GHz.

2. A Structure of a Quasi-Moebius Strip

Figure 5:
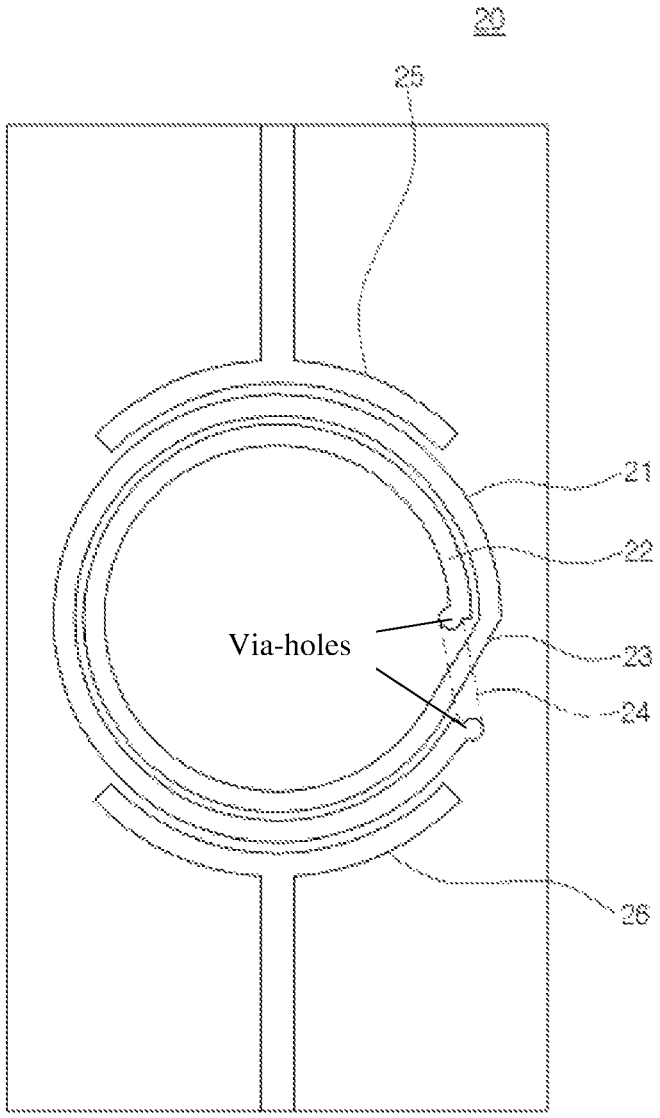
FIG. 5 is a schematic diagram showing a ring resonator having a quasi-Moebius strip structure
Figure 6:
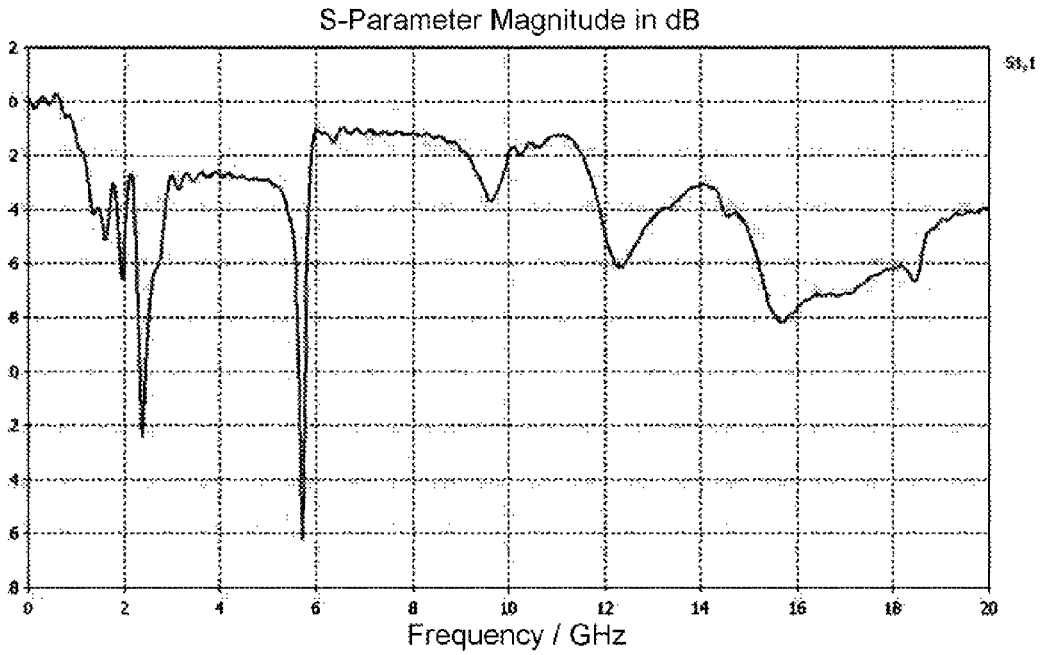
FIGS. 6 and 7 are graphs showing an input terminal reflection coefficient and a forward transfer coefficient of the ring resonator shown in FIG. 5.
Figure 7:
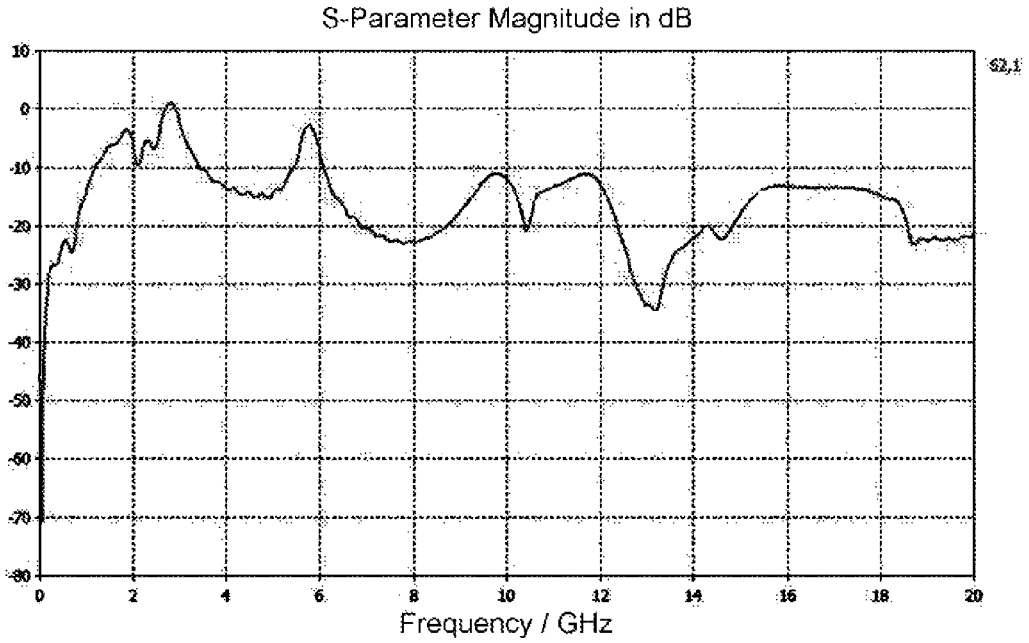
Figure 8:
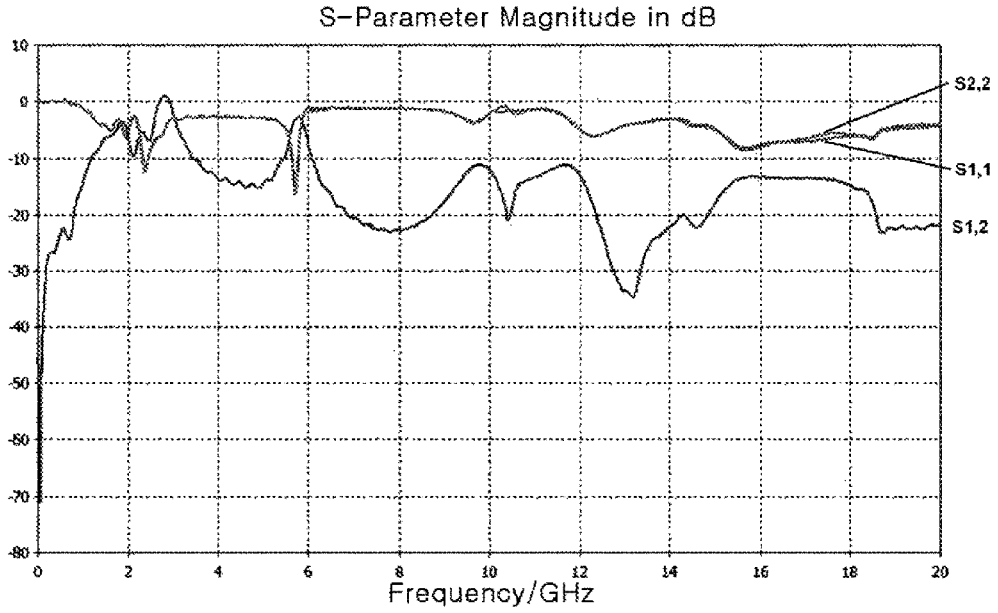
FIG. 8 is an S-parameter graph of the ring resonator shown in FIG. 5.

FIG. 5 is a schematic diagram showing a ring resonator having a quasi-Moebius strip structure. FIGS. 6 and 7 are graphs showing an input terminal reflection coefficient and a forward transfer coefficient of the ring resonator shown in FIG. 5. FIG. 8 is an S-parameter graph of the ring resonator shown in FIG. 5.

FIG. 5 shows a structure of a ring resonator having a quasi-Moebius strip structure in which the Moebius strip is cut one time along the circumference (N=1, N is a number of cuts of Moebius strip).

The Moebius strip has a phase difference of 180 degrees between an inner space and an outer space. In other words, the Moebius strip has the characteristic of an open space where the inner space is connected to the outer space rather than a space where the inner space is separated from the outer space.

Accordingly, the Moebius strip has a characteristic of becoming one strip having a circumference twice longer than that before cut, rather than split into two strips when cut along the circumference.

In other words, the Moebius strip has no beginning and has one surface topologically. In addition, the Moebius strip is similar to a cylinder, but has a surface having a boundary rather than a general surface. In addition, the Moebius strip is not a three-dimensional closed space, but a two-dimensional open space.

As shown in FIG. 5, the ring resonator 20 having the quasi-Moebius strip structure may include first and second loops 21 and 22 having a structure formed by cutting the Moebius strip one time along the circumference, a first bridge 23 sequentially connecting on ends of the first and second loops 21 and 22, and a second bridge 24 for connecting via-holes formed at one end of a second loop 22 arranged at an inner side and one end of a first loop 21 arranged at an outer side, respectively.

Herein, although formed as concentric ring lines having different diameters, respectively, the first and second loops 21 and 22 have a single resonance frequency characteristic.

One of the first bridge 23 and the second bridge 24 may be arranged on a front surface of the first and second loops 21 and 22, and the other one may be arrange on a rear surface of the first and second loops 21 and 22.

Accordingly, according to the ring resonator 20 having the quasi-Moebius strip structure cut one time, as shown in FIGS. 6 to 8, the resonance occurs at about 6 GHz.

3. A Ring Resonator Having a Quasi-Moebius Strip Structure Cut Two Times

Figure 9:
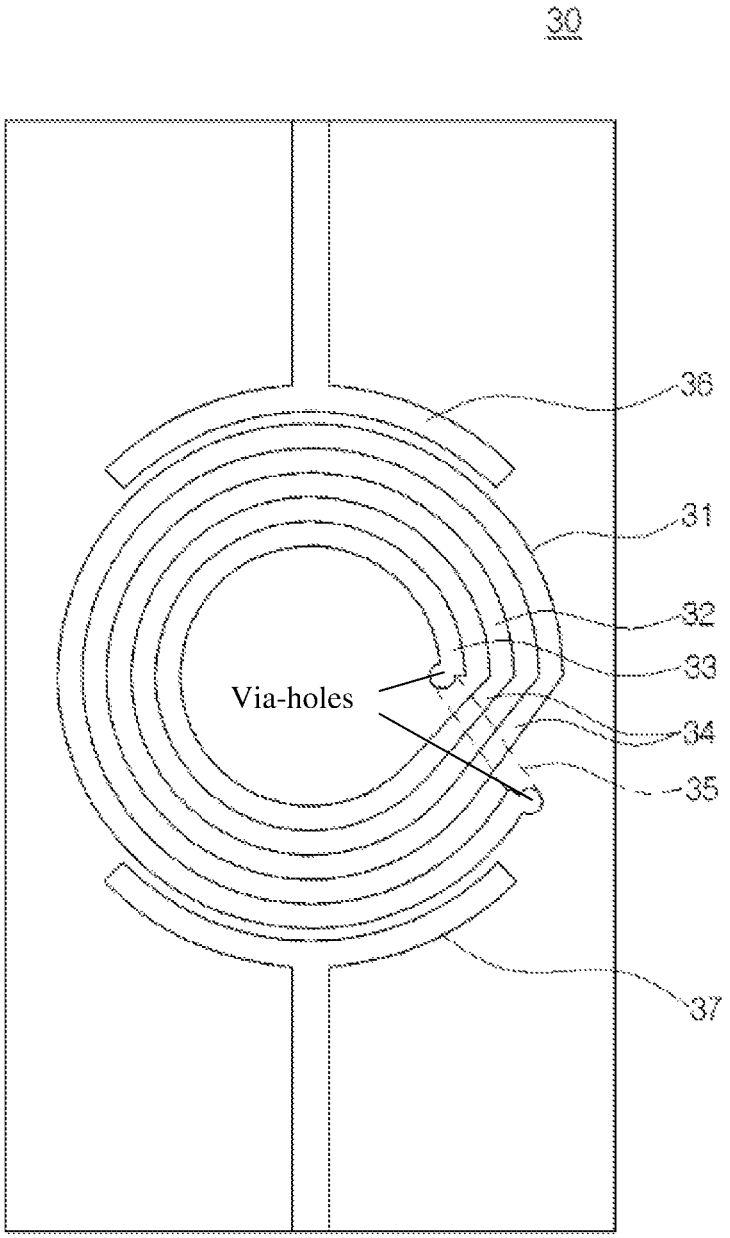
FIG. 9 is a schematic diagram showing a ring resonator having a quasi-Moebius strip structure cut two times.
Figure 10:
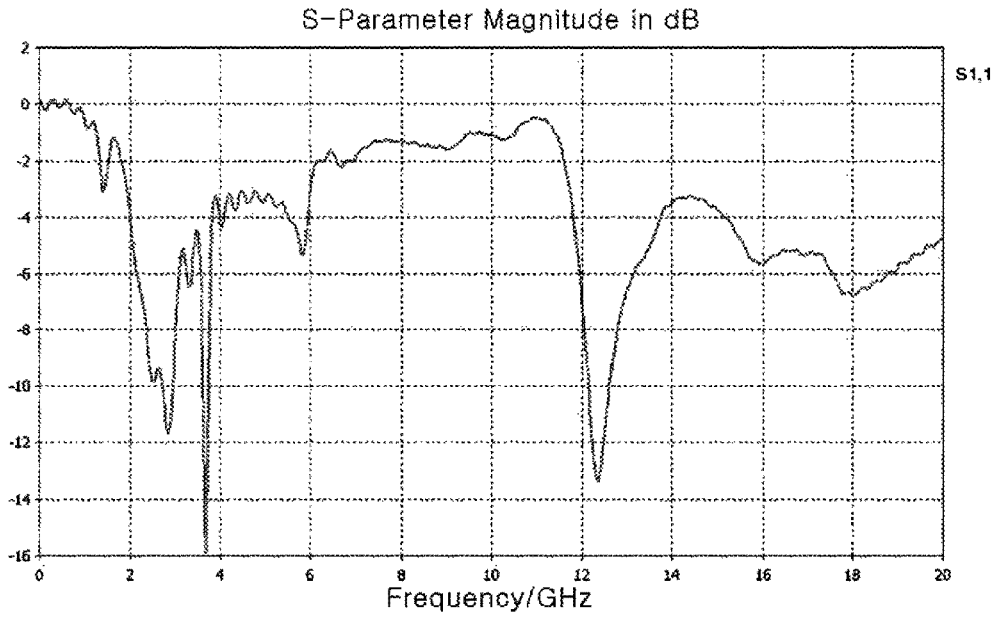
FIGS. 10 and 11 are graphs showing an input terminal reflection coefficient and a forward transfer coefficient of the ring resonator shown in FIG. 9.
Figure 11:
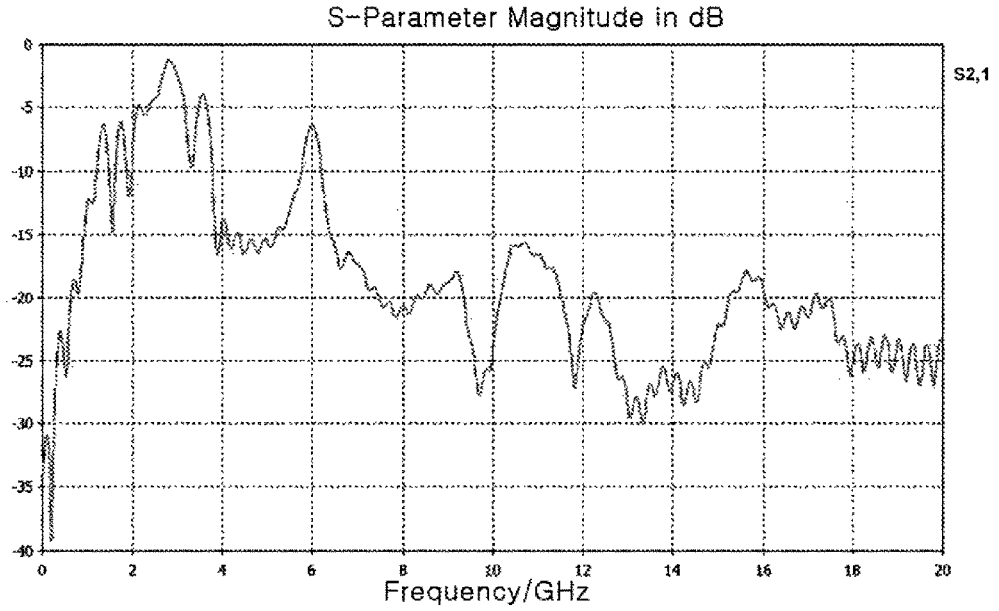
Figure 12:
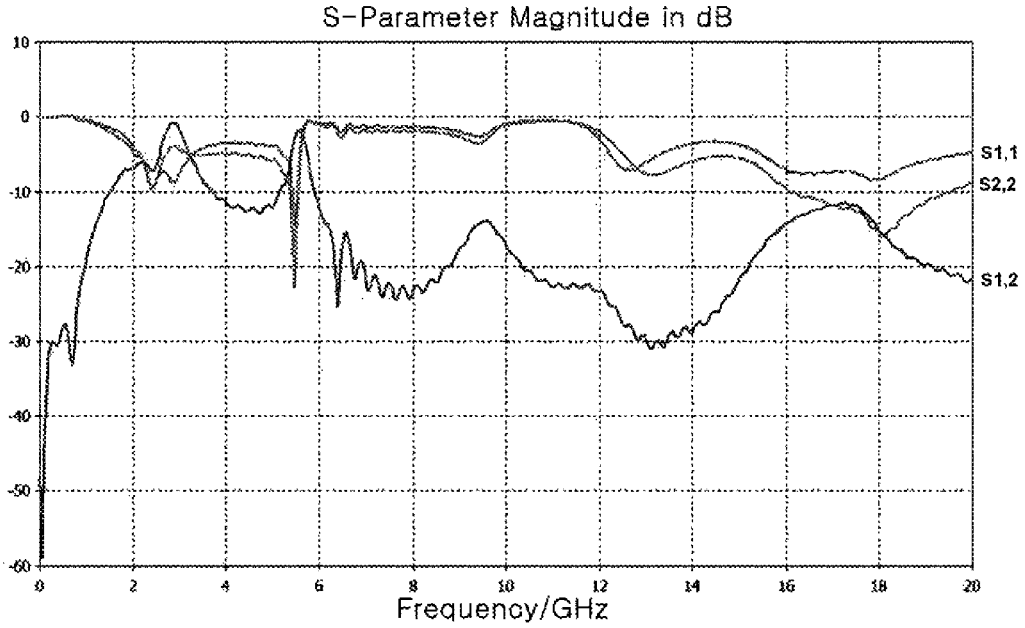
FIG. 12 is an S-parameter graph of the ring resonator shown in FIG. 9.

FIG. 9 is a schematic diagram showing a ring resonator having a quasi-Moebius strip structure cut two times. FIGS. 10 and 11 are graphs showing an input terminal reflection coefficient and a forward transfer coefficient of the ring resonator shown in FIG. 9. FIG. 12 is an S-parameter graph of the ring resonator shown in FIG. 9.

FIG. 9 shows a structure of a ring resonator having a quasi-Moebius strip structure in which the Moebius strip is cut two times along the circumference (N=2).

As shown in FIG. 9, the ring resonator 30 having the quasi-Moebius strip structure may include first to third loops 31 to 33 having a structure formed by cutting the Moebius strip two times along the circumference, a first bridge 34 sequentially connecting on ends of the first to third loops 31 to 33, and a second bridge 35 for connecting via-holes formed at one end of the third loop 33 arranged at an inner most side and one end of the first loop 31 arranged at an outermost side, respectively.

Herein, the first to third loops 31 to 33 are formed as ring lines having different diameters, and have a single resonance frequency characteristic.

One of the first bridge 34 and the second bridge 35 may be arranged on a front surface of the first to third loops 31 and 33, and the other one may be arrange on a rear surface of the first to third loops 31 and 33.

Thus, according to the ring resonator 30 having the quasi-Moebius strip structure cut two times, as shown in FIGS. 10 to 12, the resonance occurs at about 1.35 GHz.

Herein, as shown in FIGS. 8 and 12, subject to the same length of a physical wavelength, when the number (N) of cutting along the circumference of the quasi-Moebius strip increases, the resonance frequency of the ring resonator having the quasi-Moebius strip structure becomes lower, so that the miniaturization of the physical wavelength may be facilitated under the condition of the same resonance frequency. Thus, according to the present invention, the ring resonator may be miniaturized by increasing the number of cutting along the circumference of the quasi-Moebius strip.

II. A Design Method for Controlling a Q-Factor and a Bandwidth

According to the present invention, the bandwidth and the Q-factor are controlled by varying the rotation angle of the resonator.

Figure 13:
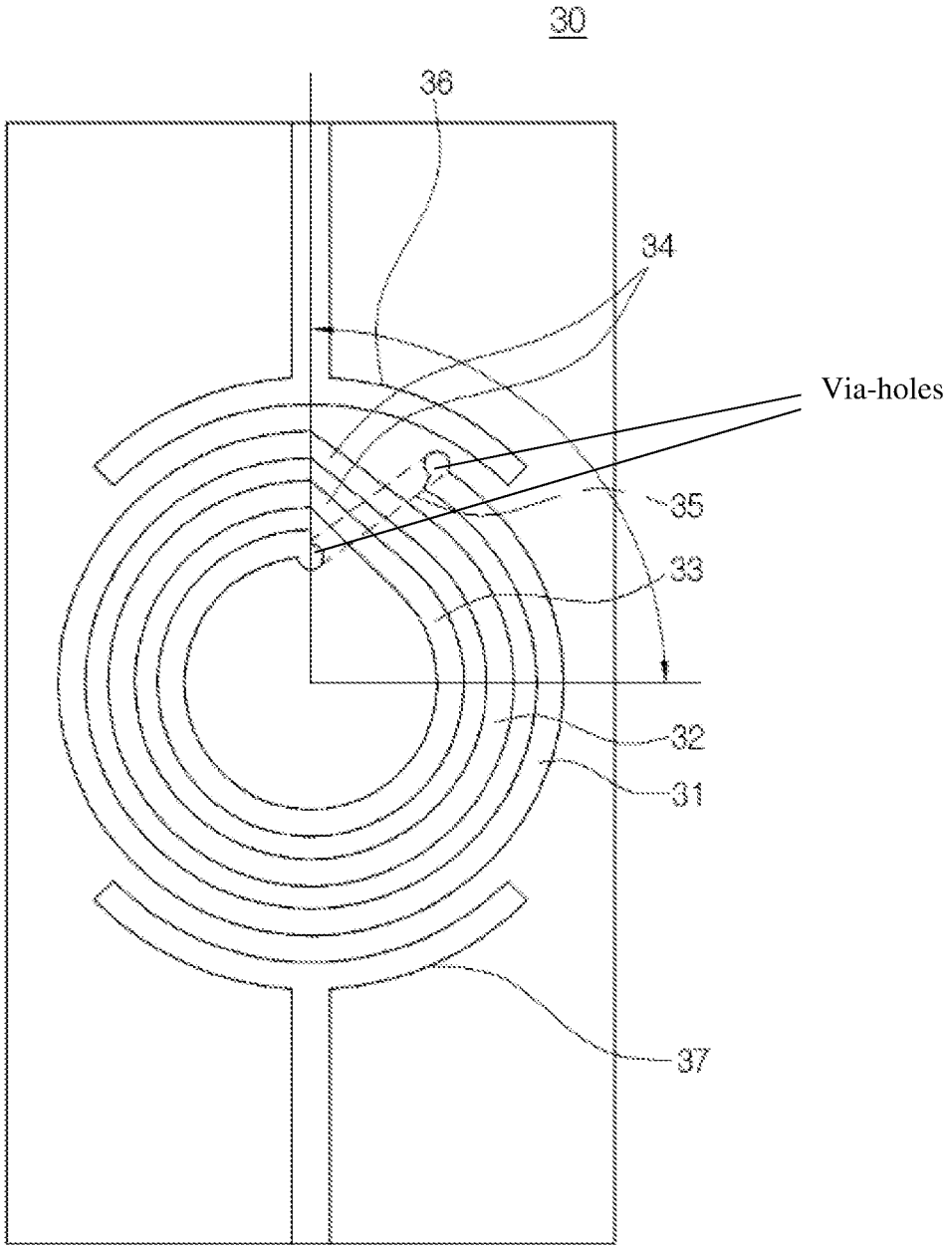
FIG. 13 is a view showing the ring resonator, shown in FIG. 9, rotated by 90 degrees.
Figure 14:
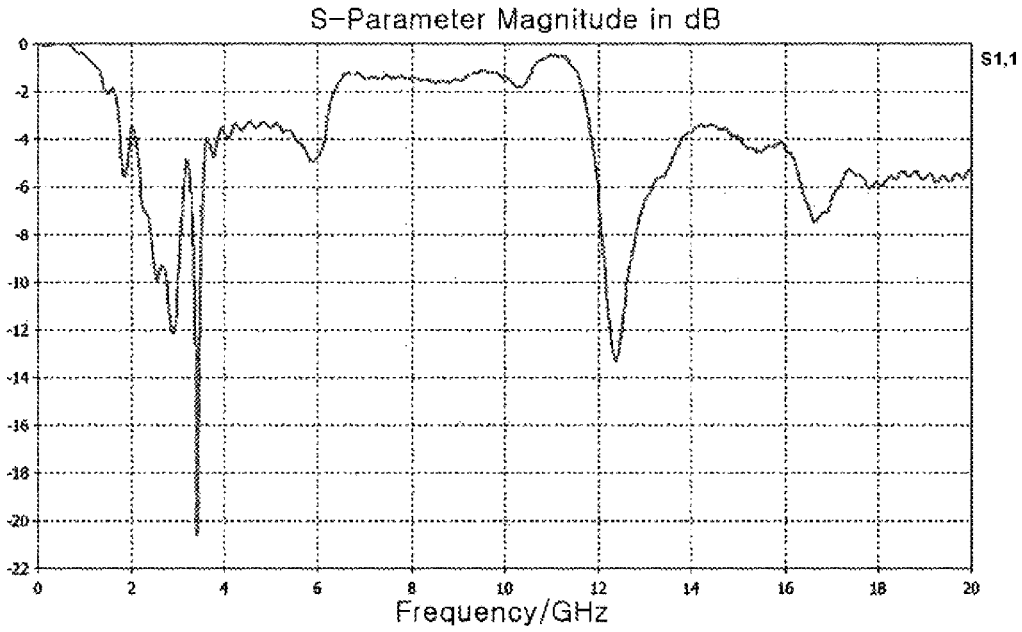
FIGS. 14 and 15 are graphs showing an input terminal reflection coefficient and a forward transfer coefficient of the ring resonator shown in FIG. 13.
Figure 15:
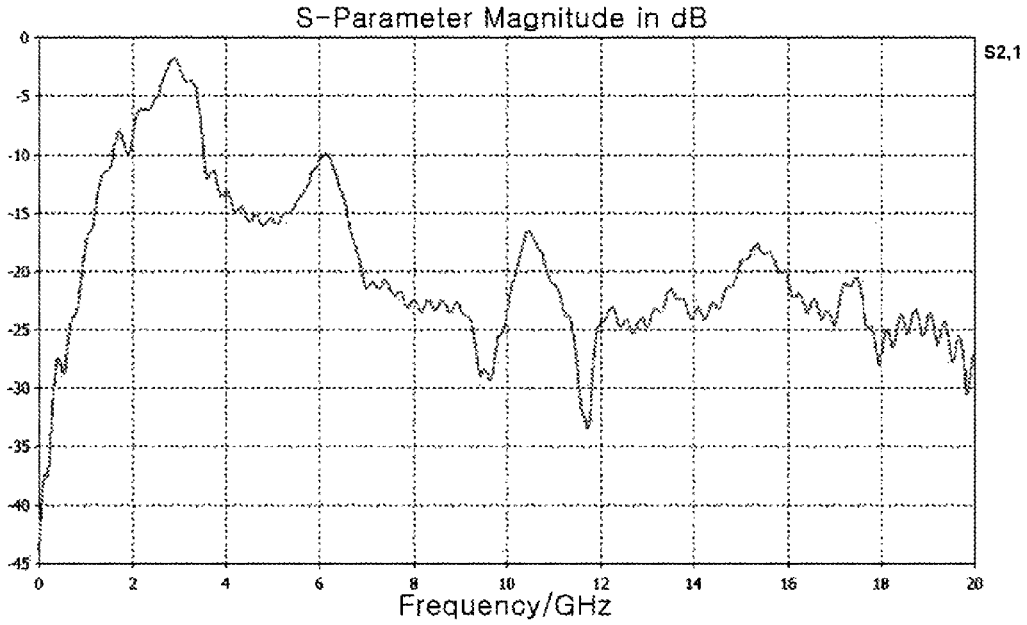
Figure 16:
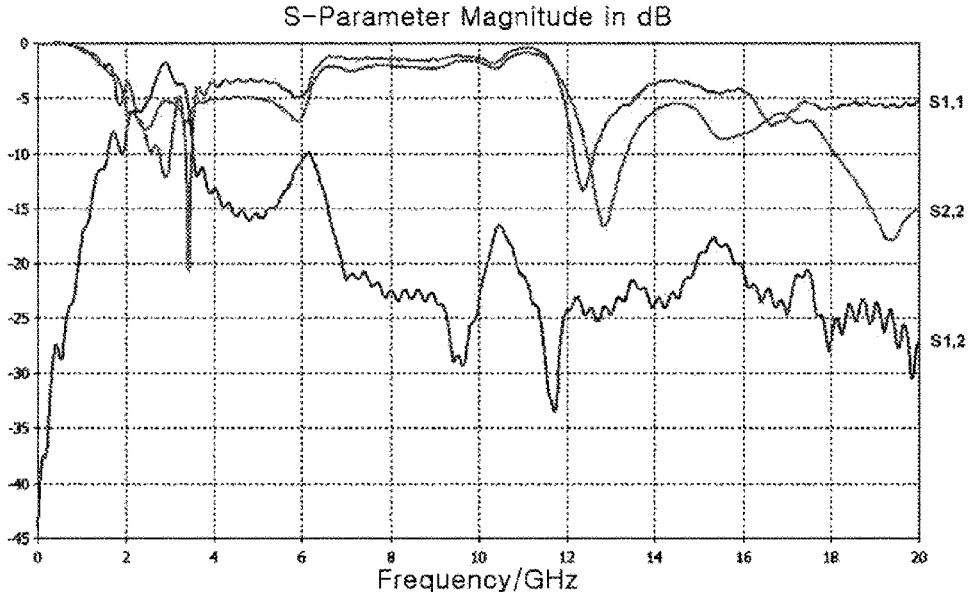
FIG. 16 is an S-parameter graph of the ring resonator shown in FIG. 13.

For example, FIG. 13 is a view showing the ring resonator, shown in FIG. 9, rotated by 90 degrees. FIGS. 14 and 15 are graphs showing an input terminal reflection coefficient and a forward transfer coefficient of the ring resonator shown in FIG. 13. FIG. 16 is an S-parameter graph of the ring resonator shown in FIG. 13.

FIG. 13 shows a state that the ring resonator 30 having the quasi-Moebius strip structure cut two times (N=2) along the circumference is rotated by 90 degrees in the counterclockwise direction.

Figure 17:
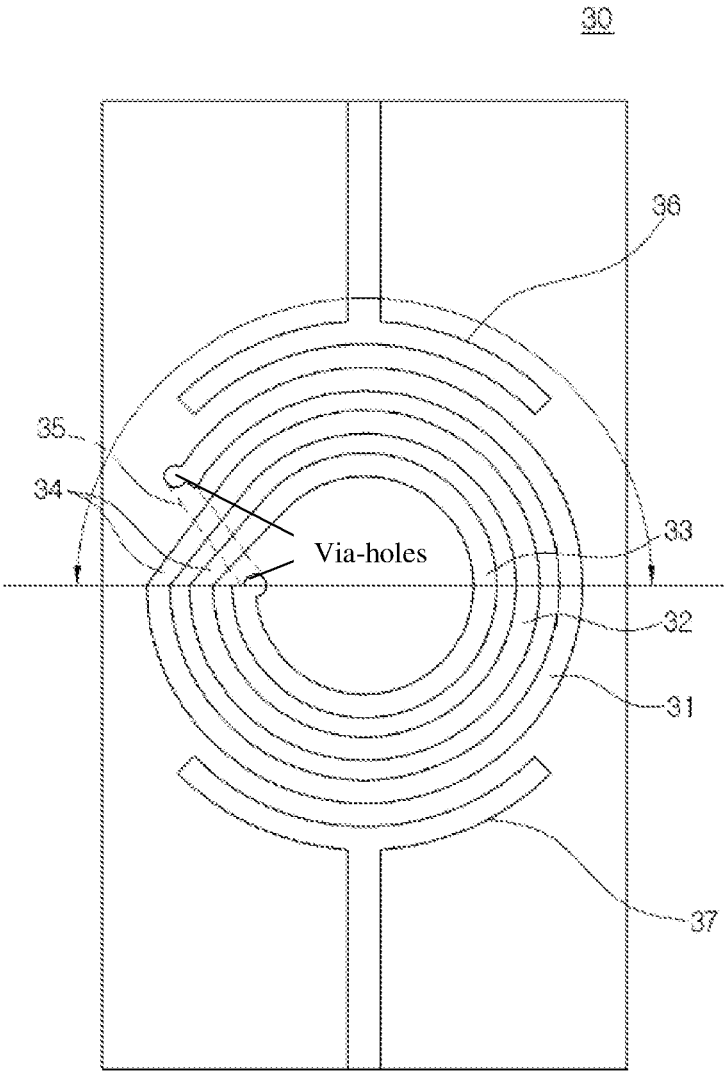
FIG. 17 is a view showing the ring resonator, shown in FIG. 9, rotated by 180 degrees.
Figure 18:
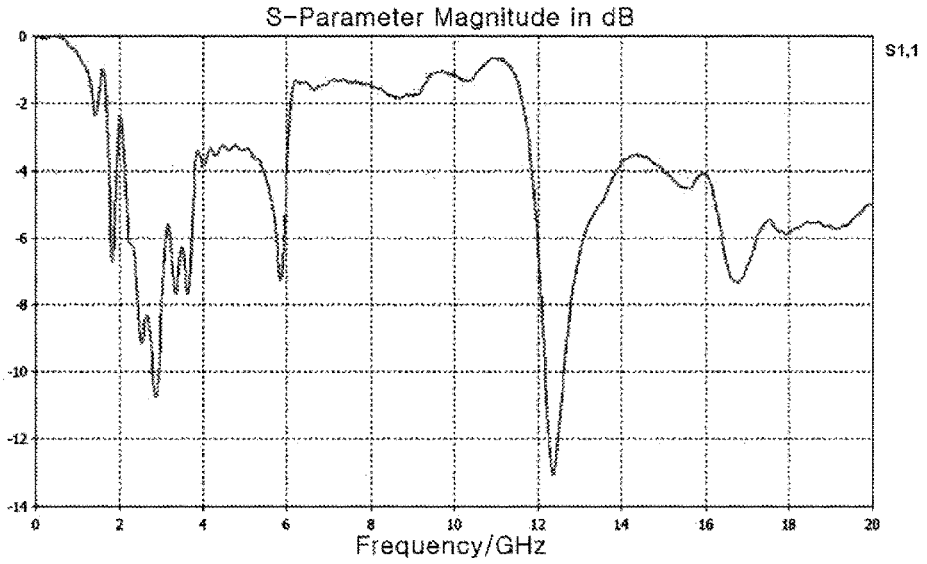
FIGS. 18 and 19 are graphs showing an input terminal reflection coefficient and a forward transfer coefficient of the ring resonator shown in FIG. 17.
Figure 19:
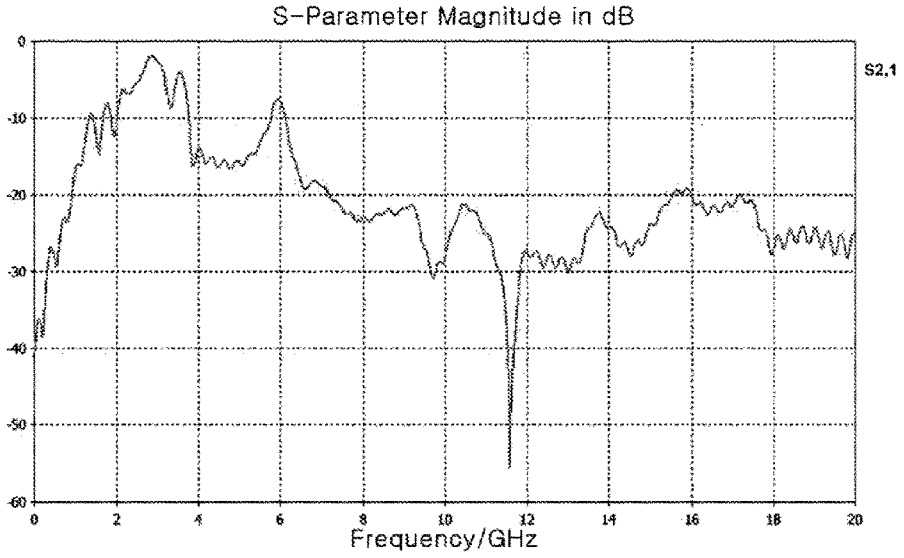
Figure 20:
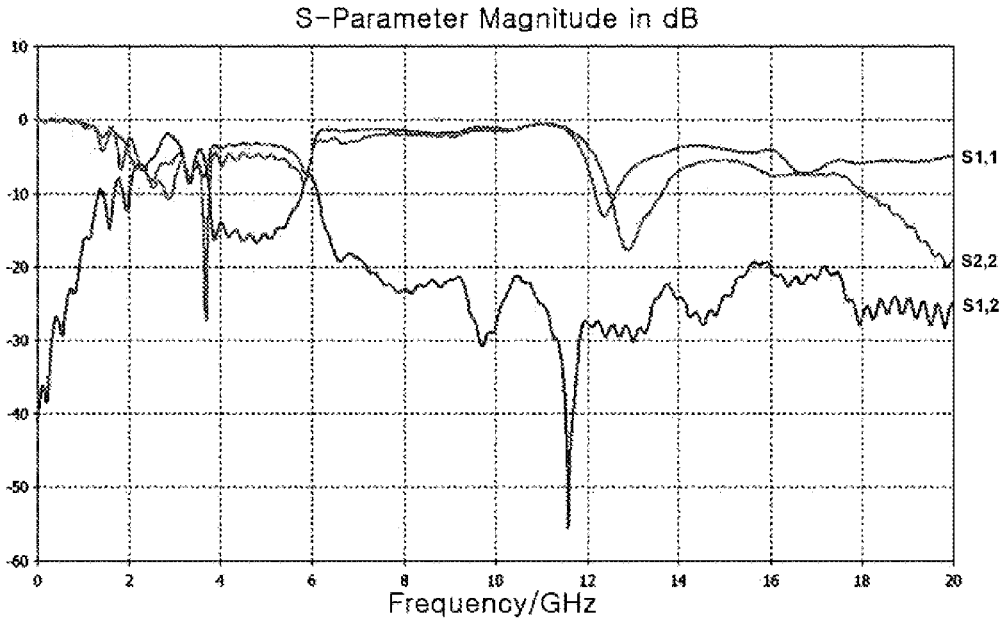
FIG. 20 is an S-parameter graph of the ring resonator shown in FIG. 17.

In addition, FIG. 17 is a view showing the ring resonator, shown in FIG. 9, rotated by 180 degrees. FIGS. 18 and 19 are graphs showing an input terminal reflection coefficient and a forward transfer coefficient of the ring resonator shown in FIG. 17. FIG. 20 is an S-parameter graph of the ring resonator shown in FIG. 17.

FIG. 17 shows a state that the ring resonator 30 having the quasi-Moebius strip structure cut two times (N=2) along the circumference is rotated by 180 degrees in the counterclockwise direction.

Figure 21:
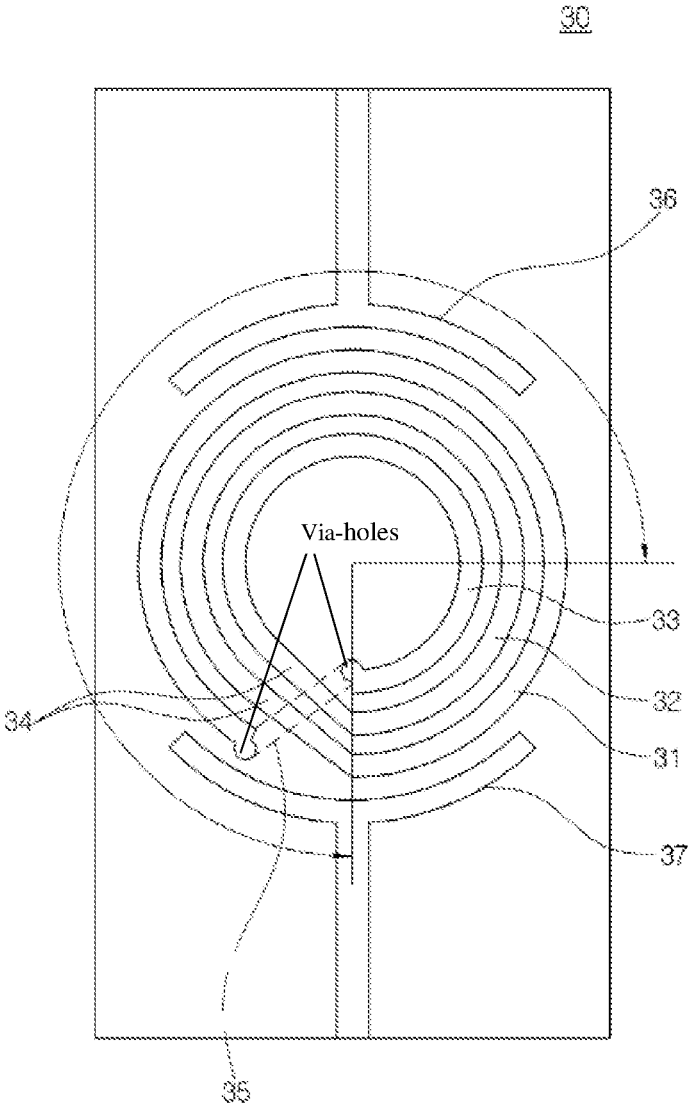
FIG. 21 is a view showing the ring resonator, shown in FIG. 9, rotated by 270 degrees.

In addition, FIG. 21 is a view showing the ring resonator, shown in FIG. 9, rotated by 270 degrees.

Figure 22:
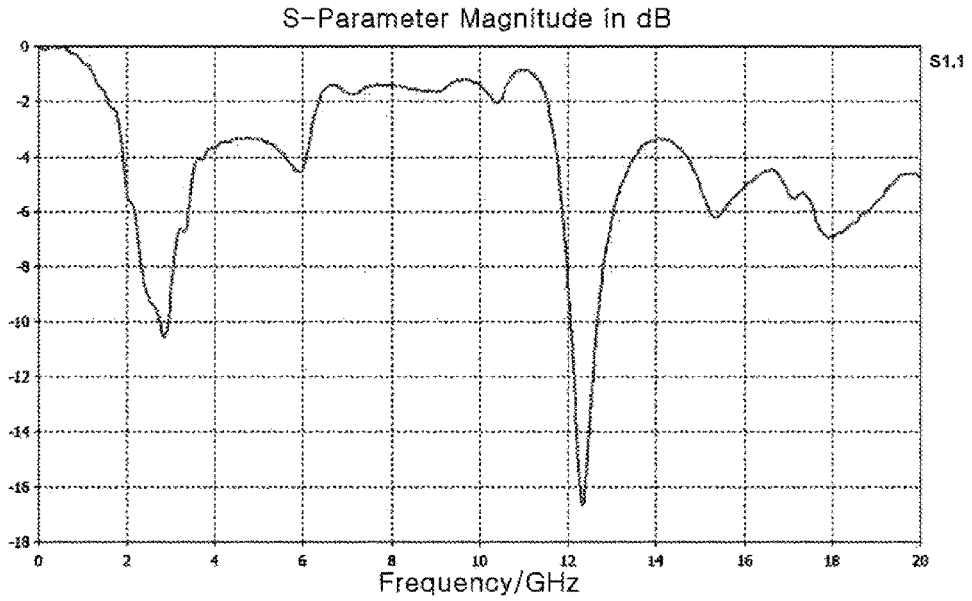
FIGS. 22 and 23 are graphs showing an input terminal reflection coefficient and a forward transfer coefficient of the ring resonator shown in FIG. 21.
Figure 23:
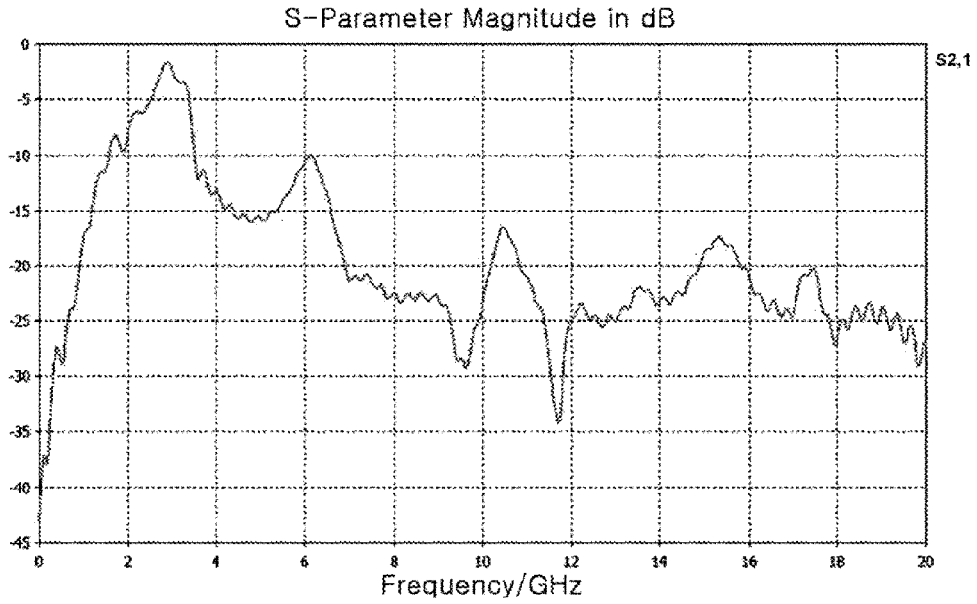
Figure 24:
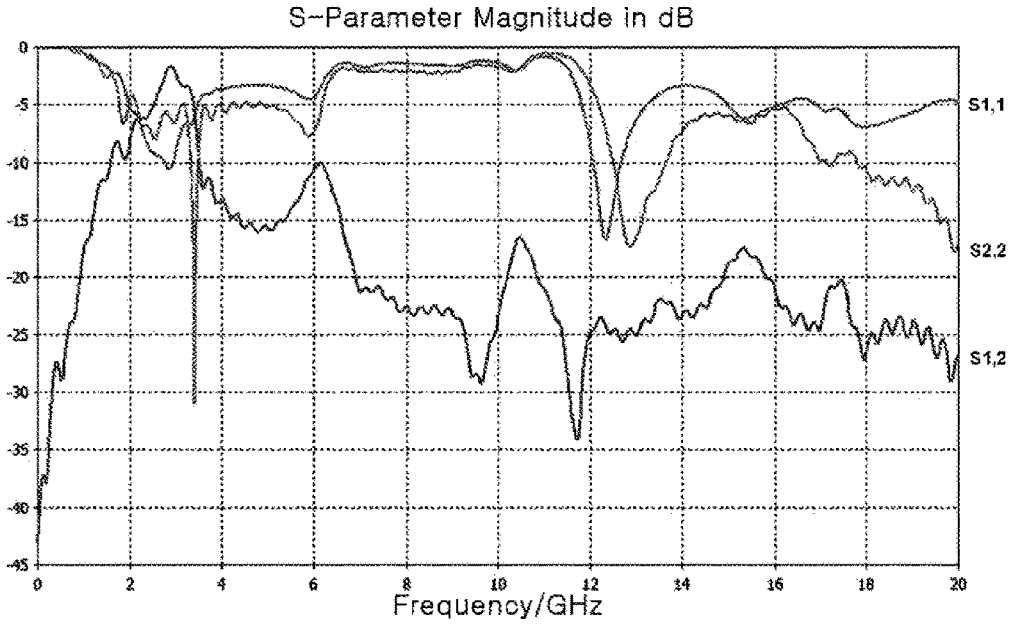
FIG. 24 is an S-parameter graph of the ring resonator shown in FIG. 21.

FIGS. 22 and 23 are graphs showing an input terminal reflection coefficient and a forward transfer coefficient of the ring resonator shown in FIG. 21. FIG. 24 is an S-parameter graph of the ring resonator shown in FIG. 21.

FIG. 21 shows a state that the ring resonator 30 having the quasi-Moebius strip structure cut two times (N=2) along the circumference is rotated by 270 degrees in the counterclockwise direction.

As shown in FIGS. 13 to 24, it is confirmed that the ring resonator 30 having the quasi-Moebius strip structure varies in the bandwidth and the Q-factor according to the rotation angle.

Thus, According to the present invention, the bandwidth and the Q-factor of the ring resonator having the quasi-Moebius strip structure may be controlled by controlling the rotation angle.

III. A Method for Designing a Unit Resonance Cell of a Metamaterial Applied with a Ring Resonator having a Quasi-Moebius Strip When a time-varying electric field is generated perpendicular to the ring resonator having the quasi-Moebius strip structure, an effective permeability becomes negative at a specific resonance frequency.

Accordingly, it is seen that a stop band phenomenon occurs in which a radio wave propagation cannot proceed at a specific resonance frequency.

Hereinafter, a method for designing a unit resonance cell of a metamaterial applied with the ring resonator having the quasi-Moebius strip, to control the resonance frequency and the bandwidth of the stop band caused by the generation of an electric field varying perpendicular to the quasi-Moebius strip as time goes, will be described by analyzing the characteristic of the S-parameter.

Figure 25:
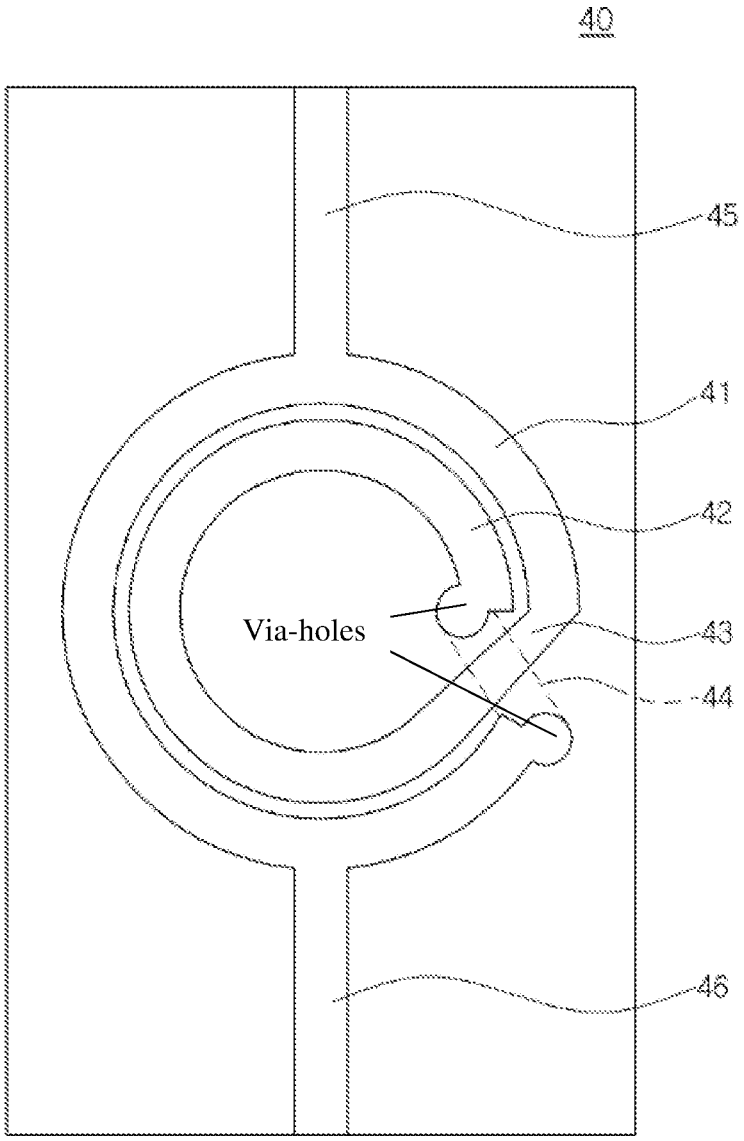
FIG. 25 is a schematic diagram showing a ring resonator having a quasi-Moebius strip.
Figure 26:
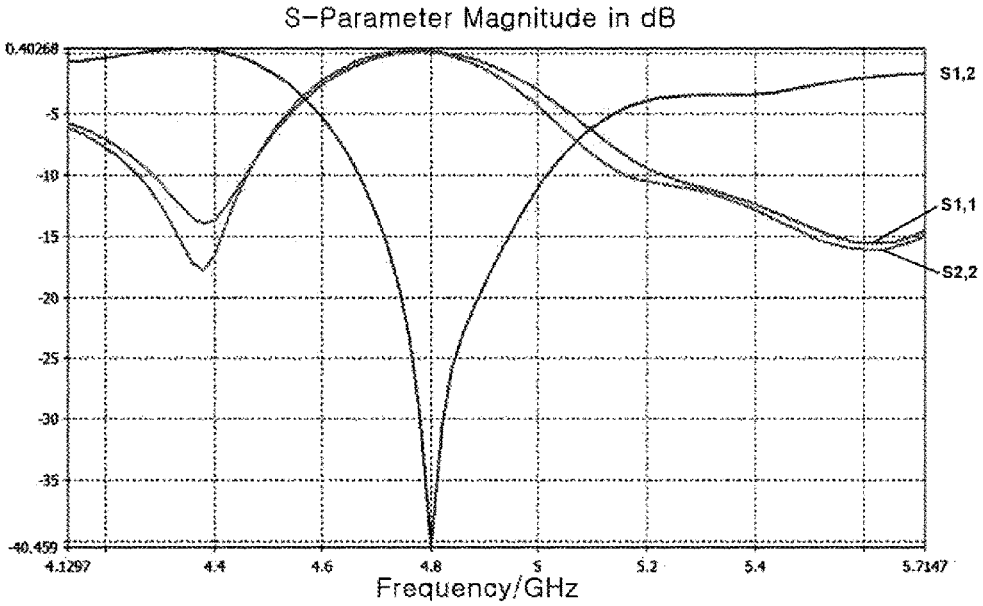
FIG. 26 is an S-parameter graph of the ring resonator shown in FIG. 25.

For example, FIG. 25 is a schematic diagram showing a ring resonator having a quasi-Moebius strip. FIG. 26 is an S-parameter graph of the ring resonator shown in FIG. 25.

FIG. 25 shows a structure of a ring resonator having a quasi-Moebius strip in which the Moebius strip is cut one time along the circumference (N=1).

As shown in FIG. 25, the ring resonator 40 having the quasi-Moebius strip has a configuration similar to the ring resonator 20 having the quasi-Moebius strip structure shown in FIG. 5. However, an input port 43 and an output port 44 may be connected to the upper and lower ends of the first loop 41, respectively.

The ring resonator having quasi-Moebius strip has a band stopping phenomenon in a frequency band from about 4.6 GHz to about 5 GHz.

In other words, it is confirmed that the effective permeability of the ring resonator having the quasi-Moebius strip becomes negative in the frequency band of about 4.6 GHz to about 5 GHz.

IV. A Method for Designing a Unit Resonance Cell of a Metamaterial Having a High Q-Factor and a Wide Bandwidth According to the present invention, the resonance frequency of the stop band is controlled by applying the structure of the above-mentioned ring resonator having the quasi-Moebius strip cut one time.

In other words, subject to the same radius of the ring resonator, when the number of cuts increases, the resonance frequency of the stop band decrease, and when the number of cuts decreases, the resonance frequency increases.

Thus, according to the present invention, the resonance frequency of the stop band may be varied by varying the number of cuts of the quasi-Moebius strip.

In addition, according to the present invention, as described with reference to FIGS. 13 to 24, the stop bandwidth may be variably controlled by changing the input impedance by rotating the ring resonator about the feed line.

Further, according to the present invention, a width of the loops constituting the quasi-Moebius strip, a spacing distance between the loops, a radius and a position of the via-hole, and a width of the bridge are varied, so that the Q-factor of the stop bandwidth can be controlled.

V. A Miniaturized Antenna Structure by Using a Surface Plasmon Resonance Phenomenon FIG. 27 is a schematic diagram showing an antenna miniaturized by using a surface plasmon resonance phenomenon according to a preferred embodiment of the present invention.

Figure 27:
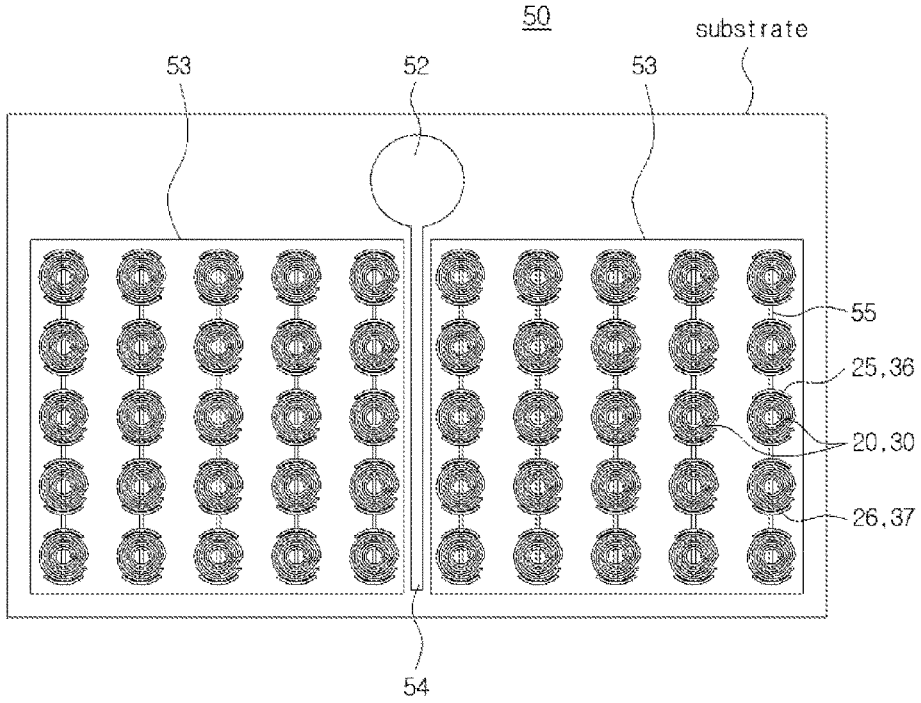
FIG. 27 is a schematic diagram showing an antenna miniaturized by using a surface plasmon resonance phenomenon according to a preferred embodiment of the present invention.

As shown in FIG. 27, the antenna 50 according to a preferred embodiment of the present invention includes a radiator 52 provided on a dielectric substrate 51; a ground plane 53 onto which a metamaterial constituting each unit resonance cell is applied using a ring resonator 20 and 30 having a quasi-Moebius strip structure to induce a surface plasmon resonance phenomenon; and a feed line 54 for connecting the radiator 52 to the ground plane 53.

Herein, although the radiator 52 is shown in a circular shape in FIG. 27, the radiator 52 may be modified into various structure such as at least one ring shape, split ring shape, and quasi-Moebius strip shape. The ground plane 53 may be provided on both sides of the feed line 52, and each unit resonance cell constituting the metamaterial applied to the ground plane 53 may be prepared as a ring resonator 20 and 30 having a quasi-Moebius strip structure cut N times (N=1, 2, 3, . . . ) along the circumference.

The feed line 54 may be electrically connected to the ring resonator 20 and 30 having the quasi-Moebius strip structure constituting each unit resonance cell of the ground plane 53 through a feed pattern formed on the rear surface of the substrate 51.

The input port 25 and 36 of the ring resonator 20 and 30 may be connected to the feed line 54, and the output port 26 and 37 may be electrically connected to the input port 26 and 37 of the ring resonator 20 and 30 of a next unit resonant cell to output a signal to the ring resonator 20 and 30 provided in the next unit resonance cell.

The metamaterial refers to a material having a permittivity or permeability less than 1 including a negative number.

The metamaterial is called variously such as a material of Epsilon Negative (ENG) having a negative permittivity, Mu Negative (MNG) having a negative permeability, Double Negative (DNG), Negative Refractive Index (NRI) and Left Handed (LH) having both negative permittivity and permeability, based on a sign of the permittivity and permeability.

The resonance type metamaterial has a periodic structure much shorter than the wavelength to have a negative permittivity or a negative permeability which does not exist as a material in a natural state at a specific frequency.

The metamaterial (MTM) is an extension of the previous physical phenomena, and has mysterious and various properties (negative refractive index, independence of wavelength and frequency, inverse of phase velocity and group delay characteristics, inverse Doppler effect, inverse focus, surface plasma, and so on).

The resonance type metamaterial is a technology of periodically and properly arranging a specific structure of a lattice spacing (1/10 or less) much shorter than the wavelength, so that a characteristic of a uniform medium is obtained from a macroscopic point of view.

The metamaterial unit resonance cell may be set to a size of about 1/5 to about 1/15 of the wavelength in order to reduce the influence, such as diffraction and scattering, between cells.

Accordingly, in this embodiment, the ring resonator 40 having the quasi-Moebius strip applied to the unit resonance cell may be miniaturized into about 1/4 in size relative to the split ring resonator in the related art.

Meanwhile, the surface plasmons (SPs) may be called surface plasmon polarities (SPPs) or plasmon surface polarities (PSPs).

Figure 28:
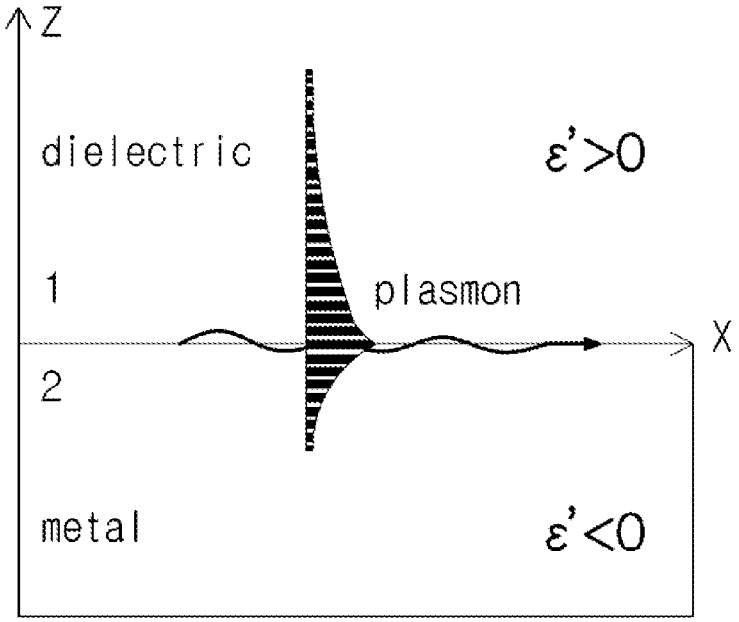
FIG. 28 is a view explaining a surface plasmon propagating along an interface between metal and a dielectric.

FIG. 28 is a view explaining a surface plasmon propagating along an interface between metal and a dielectric.

In general, as shown in FIG. 28, the surface plasmon refers to a collective oscillation of conduction band electrons propagating along an interface between metal having a negative dielectric function ($\varepsilon'<0$) and a medium having a positive dielectric function ($\varepsilon'>0$), has an enhanced size than incident light excited as a result of interaction with light (more specifically, electromagnetic waves), and has the nature and shape of an evanescent wave exponentially decreasing as moving away from the interface in the vertical direction.

In other words, the surface plasmon resonance phenomenon may be defined as a unique phenomenon caused and observed as a result of the interaction between light (photons) and nano-sized noble metal.

The surface plasmon resonance phenomenon is caused when a conductor and air generate a plasmon phenomenon in the THz frequency band.

When the surface plasmon resonance phenomenon occurs between the conductor and the air, the wavelength is minimized.

Meanwhile, since the surface plasmon resonance phenomenon according to the related art has a limitation of the THz frequency band, the surface plasmon resonance phenomenon cannot be utilized in the MHz and GHz bands currently used in the communication systems.

Therefore, according to the present invention, the metamaterial constituting the unit resonator cell applied with the ring resonator prepared as a quasi-Moebius strip is applied to the ground plane, so that the surface plasmon resonance phenomenon can be induced.

Particularly, according to the present invention, the surface plasmon resonance phenomenon, which occurs as a natural phenomenon in the THz frequency band, occurs in the MHz and GHz frequency bands by applying a material having a negative permittivity, so that the RF passive device can be miniaturized into a nanometer scale.

In addition, according to the present invention, the metamaterial constituting the ring resonator prepared as a quasi-Moebius strip is applied to the ground plane, thereby miniaturizing the unit resonator cell, so that the high Q-factor of the metamaterial can be obtained.

Particularly, according to the present invention, the stop bandwidth and the Q-factor that have a negative permeability can be controlled, based on a rotation angle of the ring resonator having the quasi-Moebius strip structure applied to each unit resonance cell about the feed line applied with an enhanced coupling gap.

In addition, according to the present invention, the physical wavelength of the CPW antenna radiator can be minimized into a nanometer scale (nm) regardless of the structure and size of the radiator by the surface plasmon resonance phenomenon between the atmosphere and the CPW antenna ground plane.

Herein, the CPW antenna has a structure in which the radiator and the ground plane are on the same plane.

As described above, when the ground plane of the CPW antenna is formed of the metamaterial, the surface plasmon resonance phenomenon can be induced.

In addition, according to the present invention, the surface plasmon phenomenon can be induced in a desired frequency band according to a structure of the ring resonator having the quasi-Moebius strip structure and the feed line applied to the unit resonance cell regardless of materials, such as graphene, metal, and copper, applied to the resonator.

Therefore, according to the present invention, the implementation for MMIC of the RF passive device, having difficulty in minimizing and integrating low-power RF passive device to communicate with nano communication systems, can be facilitated.

The present invention implemented by the inventor of the present invention is described in detail according to the above embodiments, however, the present invention is not limited to the embodiments and may be modified variously within the scope without departing from the invention.

In other words, the above-described embodiment describes the ring resonator having the quasi-Moebius strip structure and a small-sized antenna in which the metamaterial configured by the unit resonant cell is applied to the ground plane by using the ring resonator, however, the present invention is not limited thereto and may be modified to be applied to various RF passive devices used in the field of wireless communication and wireless power transmission such as a resonator, an antenna, and an oscillator.

INDUSTRIAL APPLICABILITY

The present invention may be applied to an RF passive device minimized into a nanometer scale by inducing a surface plasmon resonance phenomenon by applying a metamaterial having a negative permittivity, and a miniaturization technology therefor.

The invention claimed is:

1. A radio frequency (RF) passive device comprising:

a radiator provided on a dielectric substrate;

a ground plane onto which a metamaterial constituting a plurality of unit resonance cells is applied, wherein each unit resonance cell includes a ring resonator of a quasi-Moebius strip structure; and a feed line for electrically connecting the radiator to the ring resonator, wherein the RF passive device is miniaturized in nanometers by inducing a surface plasmon resonance phenomenon between air and the ground plane, and wherein a frequency in which the surface plasmon resonance phenomenon is induced is varied by modifying a structure of the ring resonator and the feed line connected to the ring resonator.

2. The RF passive device of claim 1, wherein the ring resonator comprises:

a plurality of loops formed by cutting the Moebius strip at least one time along a circumference thereof;

a first bridge sequentially connecting ends of the loops to each other; and a second bridge for connecting via-holes formed at one end of an innermost loop and one end of an outermost loop, respectively.

3. The RF passive device of claim 2, wherein one of the first bridge and the second bridge is arranged on a front surface of the dielectric substrate, and a remaining one is arranged on a rear surface of the dielectric substrate.

4. The RF passive device of claim 2, wherein the feed line is connected to an input port of each of the loops through a feed pattern formed on a rear surface of the dielectric substrate, and an output port of each of the loops is electrically connected to an input port of the ring resonator provided in a next resonant cell.

5. The RF passive device of claim 4, wherein the RF passive device is configured to control a Q-factor and a bandwidth by adjusting a rotation angle of the ring resonator about the feed pattern.

6. The RF passive device of claim 2, wherein the ring resonator is configured to adjust a resonance frequency and a reflection coefficient by varying a thickness of the respective loops, a width of the respective bridges, and a radius and a position of the via-holes.

7. The RF passive device of claim 2, wherein the ring resonator is configured to control a Q-factor of a stop bandwidth by varying a width of the respective loops, a spacing distance between the loops, a radius and a position of the respective via-holes, and a width of the bridge.

8. The RF passive device of claim 2, wherein the loops of the ring resonator include ring lines having different diameters, and have a single resonant frequency characteristic.

9. A miniaturization method for the RF passive device of claim 1, the method comprising:

(a) constructing the plurality of unit resonance cells by using the ring resonator having the quasi-Moebius strip structure for each unit resonance cell;

(b) applying the metamaterial provided with the plurality of unit resonance cells to the ground plane; and (c) electrically connecting the radiator to the ring resonator by using the feed line.

* * * * *